United States Patent [19]

Barlow

[11] Patent Number: 4,894,921

[45] Date of Patent: Jan. 23, 1990

[54] RANGEFINDER BOW SIGHT

[76] Inventor: William J. Barlow, Rt. 1, Box 504, Norwood, N.Y. 13668

[21] Appl. No.: 286,155

[22] Filed: Dec. 19, 1988

[51] Int. Cl.[4] ..... F41G 1/32

[52] U.S. Cl. ..... 33/265

[58] Field of Search ..... 33/265, 366, 391, 241; 124/87

[56] References Cited

U.S. PATENT DOCUMENTS

| | | | |
|---|---|---|---|
| 4,400,887 | 8/1983 | Mason | 33/265 |
| 4,580,349 | 4/1986 | Webb et al. | 33/265 |
| 4,616,422 | 10/1986 | Gaddy | 33/265 |

*Primary Examiner*—Harry N. Haroian

*Attorney, Agent, or Firm*—Wall and Roehrig

[57] ABSTRACT

An archery rangefinder sight comprises a housing affixed onto the bow, with a power supply and a rotary mechanical or magnetic switch that has a shaft protruding through a side wall of the housing. A bowsight element employs a number of sight pins vertically spaced above one another and mounted either on the case or as a separate element attached to the bow. A number of LED's or lamps are mounted on the housing so as to be visible to the archer when aiming the bow. A weighted pendulum arm is adjustably mounted on the switch rotary shaft to rotate the same as the bow inclination changes. Then one of the lamps becomes illuminated to indicate the range to target, and the bow is aimed and shot according to a respective one of the sight pins.

7 Claims, 2 Drawing Sheets

RANGEFINDER BOW SIGHT

BACKGROUND OF THE INVENTION

This invention relates to archery accessory devices, and is more particularly directed to rangefinder bow sights of the type in which a vertical array of sight pins is used to aim the bow, depending on the range to the target.

Conventional sight-pin aiming devices can assist an archer or bow hunter in aiming correctly at a target or game animal. These are effective for level-ground shooting.

When the archer and target are at different elevations a change in the range to the target will produce a change in the angle between the archer and the target. The inclination angle can be used to establish range from a known elevation. It is usually the case in bow hunting for the hunter to establish an elevated position in a tree stand or blind near a game trail, and await the approach of a deer or other game animal. Once the deer comes within range, the hunter will usually have only one opportunity to use his arrow, so the shot must be made to count. Thus, it is highly important that accurate aim be established, taking into account the distance to the deer.

Several rangefinder sights have been proposed, which have both advantages and drawbacks. In one version, a mechanical arrangement of sight pins pivots up and down as the bow is angled to different elevations. However, sights such as this have an undesirable sway about their pivots, which makes accurate sighting difficult. Other versions employ a plurality of light-emitting sight pins, which all light at once, leaving range selection entirely to the archer's judgment. Still another proposed rangefinder sight employs a number of mercury tilt switches which close at a variety of different bow angles and light associated illuminated sight pins as the bow's inclination angle changes. However, mercury switches tend to have rather inexact on/off points so that there is a great deal of uncertainty in aim. This inexactness, and the tendency to light more than one sight pin at a time, places severe limits on shooting accuracy, and renders the device too unreliable to use in many situations.

OBJECTS AND SUMMARY OF THE INVENTION

It is an object of this invention to provide a bow sight to indicate the correct aim for an archer for a variety of ranges to the target, and for a variety of elevations.

It is another object to provide a rangefinder bow sight which is accurate and which can respectively indicate the correct range.

According to an aspect of this invention, an archery rangefinder sight is mounted onto a bow for sighting at a target from an elevated shooting position. A case or housing is affixed on the bow and contains a battery power supply. A rotary switch device has a shaft that protrudes a side wall of the case. The switch device can for example, be a mechanical rotary switch or a magnetic rotary switch. A plurality of sight pins are vertically spaced relative to each other and are mounted either on the case or on a separate bowsight element attached to the bow. There are a like number of LED's or lamps mounted on a proximal wall of the housing, or elsewhere, so that they are visible to the hunter or archer when aiming the bow. The switch operatively connects these to the battery so that one of them at a time will be lit as the inclination angle of the bow changes.

A weighted pendulum arm is adjustably mounted on the rotary switch shaft to rotate the switch as the bow inclination changes. The rotary position of the pendulum arm on the shaft can be adjusted for changes in elevation.

Once the bow hunter is established in a tree stand, the bow can be sighted into an object at a fixed range on the ground. The pendulum position is adjusted until the appropriate lamp or LED is illuminated. Then, the pendulum is fixed in place on the shaft, e.g., with a set screw. This establishes the bow inclination angles for lighting each of the lamps or LED's at the correct range for each sight pin, e.g., 15 yards, 20 yards, 30 yards, etc.

The above and many other objects, features and advantages of this invention will be more fully appreciated from the ensuing description of a preferred embodiment, which is to be read in connection with the accompanying Drawing.

DETAILED DESCRIPTION OF THE PREFERRED EMBODIMENTS

Figure 1:
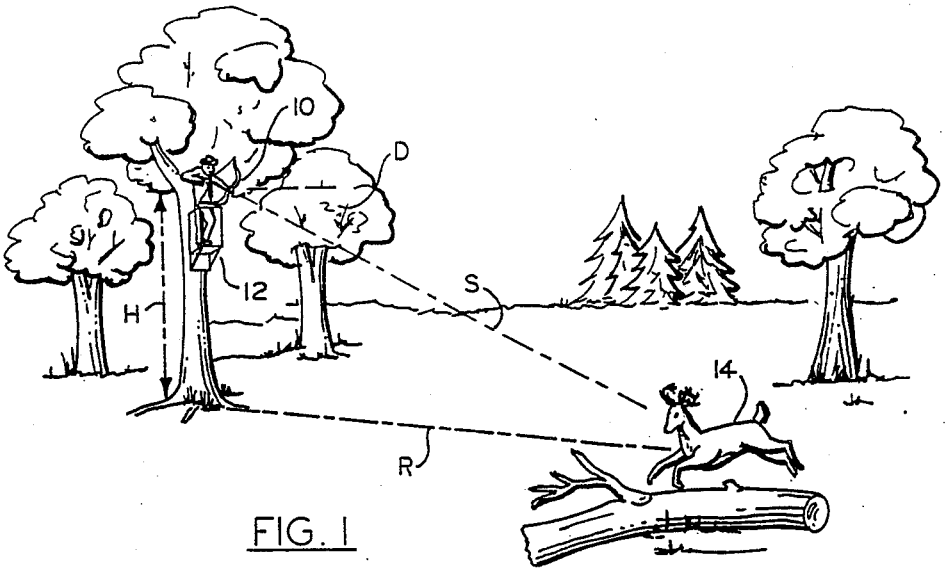
FIG. 1 is a perspective view showing an archery deer hunter, tree stand, and deer, to illustrate range and aim problems of bow hunting.

With reference to the drawing, and initially to FIG. 1 thereof, an archer or bow hunter 10 is shown in an elevated position in a tree stand 12, which establishes a shooting elevation H. A deer 14 in the vicinity of the bow hunter 10 presents itself as a target at a slant range S and corresponding horizontal range R from the hunter 10. Because the hunter is at the elevation H with respect to the deer or target 14, the aim of the bow is inclined downward at a declination angle D, which, of course, varies with the range R for any given elevation H. The archer 10 will have to aim the bow differently for different ranges because the trajectory of the arrow is not flat.

Figure 2:
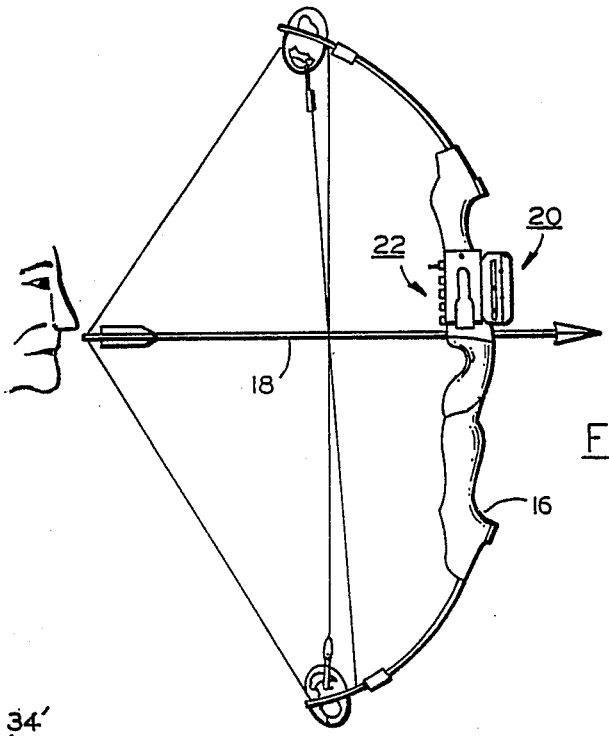
FIG. 2 is a side elevation of a hunting bow, with a rangefinder sight according to one embodiment of the present invention.
Figure 3:
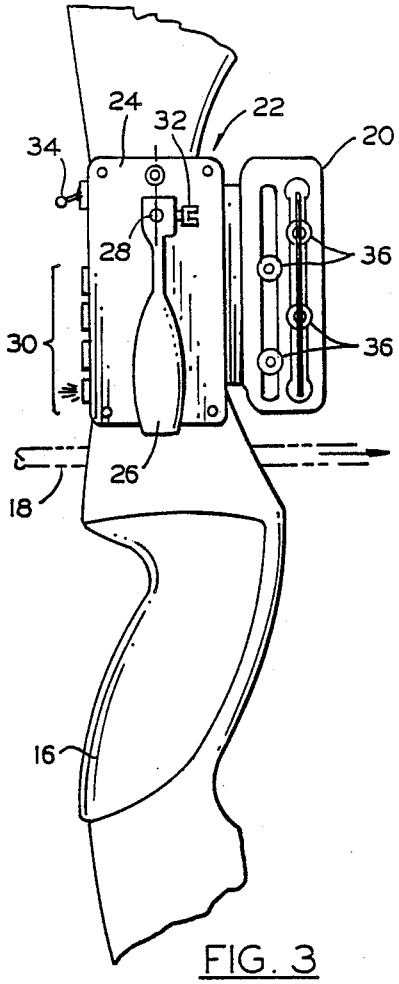
FIGS. 3 and 4 are partial side elevations of the bow sight of this embodiment, in the horizontal or level-aim mode and inclined downward, respectively.
Figure 4:
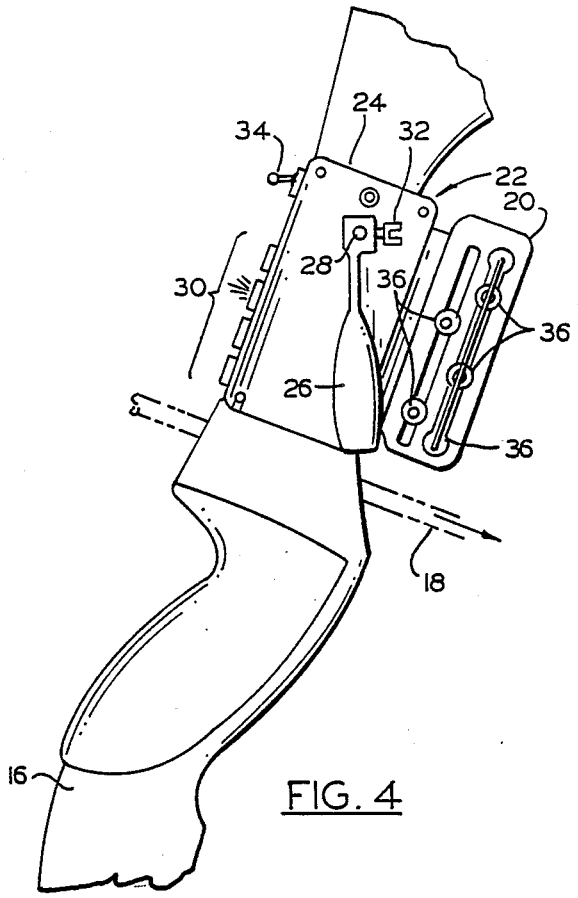
Figure 5:
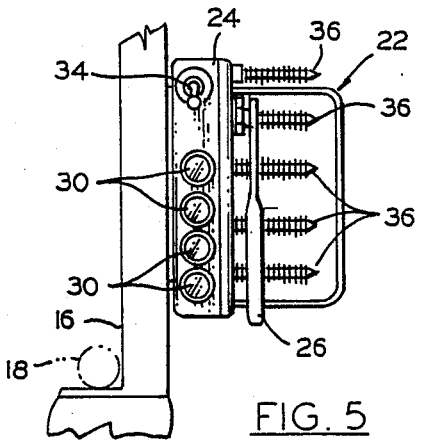
FIG. 5 is a rear elevation of the bow sight of this embodiment.

A compound bow 16 is shown in FIG. 2 with an arrow 18 shown in the drawn position, and aimed horizontally. A bow sight 20 is installed on the bow above the arrow rest. As shown in FIGS. 3 and 4, a multi-pin bow sight 20 is mounted distally of a rangefinder 22. The latter comprises a housing 24 that is affixed onto the side of the bow 18. A pendulum is swingably mounted on a side wall of the housing 24 and is shown here affixed onto a shaft 28 that protrudes through the housing side wall. A plurality of lamps or LED's 30 are arranged vertically on the proximal wall of the housing 24. A set screw 32 on the pendulum 26 can be loosened to adjust the rotational orientation and then can be set to lock the pendulum to the shaft 28. An on/off switch 34 is also provided on the proximal wall of the housing, and a plurality of vertically arranged, adjustable sight pins 36 extend laterally from the bow sight 20. As shown in FIG. 5, a rotary switch 30 within the housing is attached to the shaft, and has outputs coupled to respective ones of the lamps 30 or LED's. A battery power supply 40 within the housing is connected in series with the on/off switch 34, the rotary switch 38, and the lamps 30.

As shown in FIGS. 3 and 4, as the bow is tilted and the inclination angle of the arrow 18 changes, the pendulum 26 will swing, rotating the shaft 28. The rotary switch 38 then moves from one set of contacts to another. The particular one of the lamps or LED's 30 that is illuminated indicates the range, and the lamp or LED corresponds to a particular one of the sight pins 36, which is to then be used for aiming the bow at the target.

To obtain a proper aim, the archer 10 sights the bow using the uppermost one of the sighting pins 36 (FIG. 5). The inclination of the bow 16, and the amount of rotation of the pendulum 26 and shaft 28, will depend on the proximity of the deer 14 to the hunter 10 and tree stand 12. One of the lights or LED's 30 will become illuminated, which indicates the proper range to the target. The archer 10 then aims and shoots according to an associated one of the remaining sight pins 36.

Figure 7:
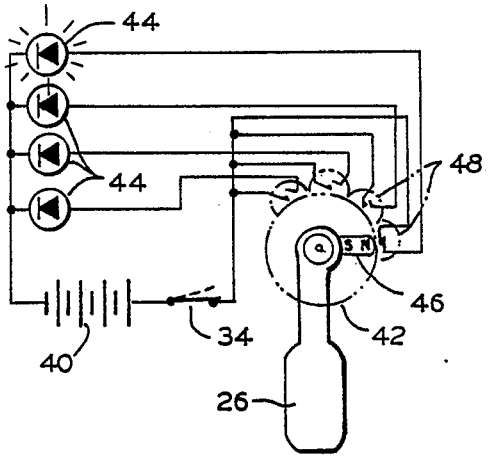

An alternative circuit arrangement is shown in FIG. 7, which incorporates a magnetic switch 42 for selectively connecting the battery power supply 40 to a particular one of a plurality of LED's 44. The magnetic switch 42 includes a permanent magnet 46 that rotates with the pendulum 26 and shaft 28, and a plurality of miniature reed switches 48 arranged at predetermined angles around the axis of the shaft 28 along the path of the magnet 46. This magnetic switch arrangement opens and closes at very precise, repeatable angles, making the rangefinder bow sight of this embodiment extremely reliable.

Figure 8:
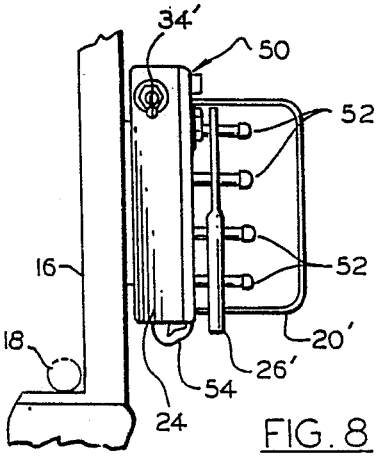
FIG. 8 is a rear elevational view of an alternative embodiment of this invention.
Figure 6:
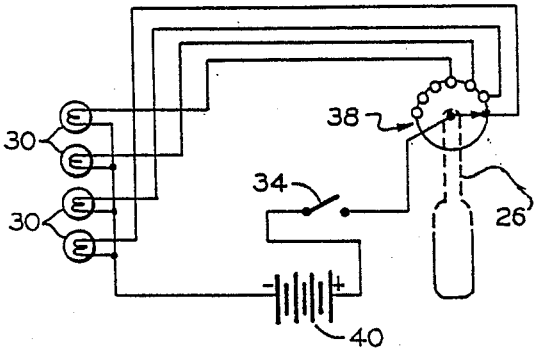
FIGS. 6 and 7 are circuit diagrams explaining the electrical connections of the bow sight of this embodiment according to two alternative arrangements.

A further embodiment of this invention is illustrated in FIG. 8, which is substantially the same as the device described earlier. Elements that are identical with those of the previous primed. Here, a rangefinder 50 is enclosed in a case or housing 24' that is mounted on the bow 16', as previously. However, instead of the LED's or lamps 30, the rangefinder 50 employs illuminated sight pins 52 on the bow sight 20'. A cable 54 connects the rangefinder 50 to the light pins 52, and the hunter or marksman simply aims employing the particular sight pin 52 that is illuminated.

While this invention has been described in detail with respect to certain preferred embodiments, it should be understood that the application is not limited to those precise embodiments. Rather, many modifications and variations would present themselves to those of skill in the art without departing from the scope and spirit of this invention, as defined in the appended claims.

What is claimed is:

1. A rangefinder archery sight to be mounted on a bow for sighting at an archery target from an elevated shooting position, comprising;

a housing including means affixing the housing to the bow;

an electrical power source in said housing;

a plurality of lamps disposed so as to be visible to an archer when aiming the bow;

a plurality of sight pins vertically spaced from one another each designating a respective shooting range and each sight pin corresponding to an associated one of said lamps;

switch means in said housing operatively connecting said power source to each of said lamps to indicate respective angular inclinations of said bow; and pendulum means swingably mounted on said housing for actuating said switch means to light said lamps in accordance with the inclination angle of said bow.

2. The archery sight of claim 1 in which said switch means includes a multiple contact rotary switch having an actuator shaft that extends out through a side wall of said housing, and said pendulum means includes a pendulum arm mounted on said shaft.

3. The archery sight of claim 2 in which said pendulum arm includes means for adjusting the rotational position of said shaft relative to the pendulum arm.

4. The archery sight of claim 1 in which said switch means includes a rotary magnetic switch having a rotary shaft that protrudes through a side wall of said housing, a magnetic actuator carried on said shaft, and a plurality of magnetically sensitive switch devices disposed along the path of said actuator and each coupled between said power source and respective ones of said lamps.

5. The archery sight of claim 4 in which said pendulum means includes a pendulum arm adjustably mounted on said shaft.

6. The archery sight of claim 1 wherein said lamps include lamp elements mounted on a proximal wall of said housing.

7. The archery sight of claim 1 wherein said lamps include LED's which are incorporated into said sight pins.

* * * * *